United States Patent [19]

Dantzig

[11] Patent Number: 4,612,972

[45] Date of Patent: Sep. 23, 1986

[54] METHOD AND APPARATUS FOR ELECTRO-MAGNETIC CASTING OF COMPLEX SHAPES

[75] Inventor: Jonathan A. Dantzig, Hamden, Conn.

[73] Assignee: Olin Corporation, New Haven, Conn.

[21] Appl. No.: 613,840

[22] Filed: May 24, 1984

Related U.S. Application Data

[63] Continuation of Ser. No. 336,656, Jan. 4, 1982.

[51] Int. Cl.[4] ..... B22D 27/02

[52] U.S. Cl. ..... 164/465; 164/467; 164/503; 164/421; 164/122

[58] Field of Search ..... 164/467, 503, 465, 421, 164/122

[56] References Cited

U.S. PATENT DOCUMENTS

| | | |
|---|---|---|
| 3,467,166 | 9/1969 | Getselev et al. . |
| 3,605,865 | 9/1971 | Getselev . |
| 3,846,082 | 11/1974 | Labelle, Jr. et al. . |
| 4,014,379 | 3/1977 | Getselev . |
| 4,158,379 | 6/1979 | Yarwood et al. . |
| 4,161,206 | 7/1979 | Yarwood et al. . |
| 4,321,959 | 3/1982 | Yarwood et al. . |

FOREIGN PATENT DOCUMENTS 868734 5/1961 United Kingdom ..... 164/465

OTHER PUBLICATIONS

Magistry et al., "Automatic Control of DC Casting with a Programmable Controller Based System", Light Metals, AIME, vol. 2, 1979, pp. 665–669.

*Primary Examiner*—Kuang Y. Lin

*Attorney, Agent, or Firm*—Howard M. Cohn; Barry L. Kelmachter; Paul Weinstein

[57] ABSTRACT

An apparatus is provided for electromagnetically coiling a molten material into a longitudinally extending casting defining a longitudinal axis thereof. The casting has a desired cross section extending perpendicular to the longitudinal axis. At least one portion of the outer peripheral surface of the casting extends transversely of the longitudinal axis and has a small radius of curvature. The apparatus includes an inductor extending transversely about the molten material for providing an electromagnetic containment force field acting on the outer peripheral surface of the molten material to form the desired cross section. The improvement comprises a device for turning the electromagnetic containment force field about the longitudinal axis to cause a corresponding turn of the transverse cross section of the molten material about the longitudinal axis.

12 Claims, 3 Drawing Figures

METHOD AND APPARATUS FOR ELECTRO-MAGNETIC CASTING OF COMPLEX SHAPES

This application is a continuation of U.S. application Ser. No. 336,656, filed Jan. 4, 1982, by Jonathan A. Dantzig, for Method and Apparatus for Electromagnetic Casting of Complex Shapes.

While the invention is subject to a wide range of applications, it is especially suited for use in the electromagnetic forming of complex shapes and will be particularly described in that connection. In particular, the process and apparatus can provide castings with a cross section that twists about the longitudinal axis extending through the casting.

The basic electromagnetic casting apparatus comprises a three-part mold consisting of a water cooled inductor, a non-magnetic screen, and a manifold for applying cooling water to the cast ingot. Such an apparatus is exemplified in U.S. Pat. No. 3,467,166 to Getselev et al. Containment of the molten metal is achieved without direct contact between the molten metal and any component of the mold. Solidification of the molten metal is achieved by direct application of water from the cooling manifold to the ingot shell.

In electromagnetically casting molten materials, high levels of control of system parameters are generally desirable to obtain high quality surface shape and condition as well as metallurgical structural tolerances. In the past, the electromagnetic casting art has included a variety of techniques and associated equipment to control the cast ingot. Several of these techniques may be used in practicing the present invention and thus a sampling of these techniques and equipment are described hereinbelow.

It is known in the art to control the ingot diameter or cross section during the casting process by control of inductor current in accordance with the teachings of U.S. Pat. No. 4,014,379 to Getselev which sets forth, for example, "a method of forming an ingot in the process of continuous and semi-continuous and semi-continuous casting of metals consisting in that the molten metal is actuated by an electromagnetic field of an inductor, in which case the current flowing through the inductor is controlled depending on the deviations of the dimensions of the liquid zone of the ingot from a prescribed value, and thereafter, the molten metal is cooled down." A similar technique is disclosed in U.S. Pat. No. 4,161,206 to Yarwood et al. which discloses, for example, "an apparatus and process for casting metals wherein the molten metal is contained and formed into a desired shape by the application of an electromagnetic field. A control system is utilized to minimize variations in the gap between the molten metal and an inductor which applies the magnetic field. The gap or an electrical parameter related thereto is sensed and used to control the current to the inductor."

Control of the level of molten metal in an electromagnetic casting environment is disclosed in U.S. patent application Ser. No. 110,893 (now abandoned) to Ungarean et al. The application discloses, for example, that "the hydrostatic pressure exerted by the molten metal in the containment zone is sensed and in response thereto the flow of molten metal into the containment zone is controlled. This minimizes changes in the hydrostatic pressure."

It is also known to sense the level of the molten metal as well as the liquid-solid interface of a casting in an electromagnetic casting environment as set forth in U.S. patent application Ser. No. 111,244 to Ungarean et al. The application discloses, for example, "a process and apparatus for determining the value of parameters which affect emissivity of radiation from a metal load in an electromagnetic casting system. Infrared radiation being emitted from the surface of the load is sensed by an array of fiber optic filaments secured within elements of the electromagnetic casting system. Radiation signals are transmitted by the filaments to a signal processor which enables readout display of electromagnetic casting parameters such as liquid temperature, maximum load temperature, position of the liquid/solid interface, and head position."

Also, U.S. patent application Ser. No. 137,645 (now abandoned) to Kindlmann et al. discloses a technique by which the height of the liquid metal head as well as the location of the liquid-solid interface can be determined for a casting being cast in an electromagnetic casting apparatus.

Once the liquid-solid interface is located, in accordance with the principles set forth in the patents mentioned above, it may be necessary to change the location of the interface. U.S. Pat. No. 4,158,379 to Yarwood et al. discloses an electromagnetic continuous or semi-continuous casting device wherein, for example, a "coolant application system may be adjustably positioned to control the solidification front at the surface of the casting without otherwise influencing the containment process through modification of the magnetic field". The solidification front may also be positioned in accordance with the teachings in U.S. Pat. No. 4,388,962 to Yarwood et al.

It is also known to shape the electromagnetically contained molten material by selective screening of the magnetic field in accordance with U.S. Pat. No. 3,605,865 to Getselev. Further, the effect of the screen itself can be varied in accordance with the principle disclosed in U.S. Pat. No. 4,161,206 to Gaule et al.

The rate of withdrawal of the casting from the electromagnetic casting device may be controlled as generally described in U.S. Pat. No. 4,353,408 to Pryor.

In order that the ingot geometry and metallurgical quality are uniform throughout the cast product, it is important that the electromagnetic molding equipment be set up so that the initial conditions are selected and fixed prior to the start-up of the electromagnetic casting run. This concept is taught in U.S. patent application Ser. No. 229,031 (now abandoned) to Yarwood et al.

In the area of DC casting, a programmable control of DC casting parameters such as casting speed and water flow has been disclosed in an article entitled "Automatic Control of DC Casting with a Programmable Controller Based System" by Magistry et al., *Light Metals*, AIME, Vol. 2, 1979, pages 665–669. This reference discloses the concept of listing parameters and a code number on a card which can be read by a controller to adjust the casting speed and the flow rate of the coolant.

The prior art, as generally mentioned above, is primarily concerned with producing castings having a substantially constant cross section. However, at present the methods for casting non-uniform cross sections are generally expensive, semi-permanent mold castings. Also, the casting of certain of the materials requires carefully controlled temperature gradient and atmosphere during the casting procedure.

It is a problem underlying the present invention to provide an apparatus and process which is capable of casting ingots having a non-uniform cross section.

It is an advantage of the present invention to provide an apparatus and process for electromagnetically forming non-uniform cross sections which substantially obviate one or more of the limitations and disadvantages of the described prior arrangements.

It is a further advantage of the present invention to provide an apparatus and process for electromagnetically forming non-uniform cross sections which would replace more expensive apparatus and control environment and thereby resulting in more efficient and economical casting.

Accordingly, there has been provided an apparatus for electromagnetically casting a molten material into a longitudinally extending casting defining a longitudinal axis thereof. The casting has a desired cross section extending perpendicular to the longitudinal axis. At least one portion of the outer peripheral surface of the casting extends transversely of the longitudinal axis and has a small radius of curvature. The apparatus includes an inductor extending transversely about the molten material for providing an electromagnetic containment force field acting on the outer peripheral surface of the molten material to form the desired cross section. The improvement comprises a device for turning the electromagnetic containment force field about the longitudinal axis to cause a corresponding turn of the transverse cross section of the molten material about the longitudinal axis.

BRIEF DESCRIPTION OF THE DRAWING

The invention and further developments of the invention are now elucidated by means of the preferred embodiments shown in the drawings.

The present invention relates to the production of castings of non-uniform cross section using electromagnetic containment with special shaped inductors. The castings can be made to have three dimensional aspects by rotating the inductor during casting and by controlling the inductor current during casting to change the size of the section.

Figure 1:
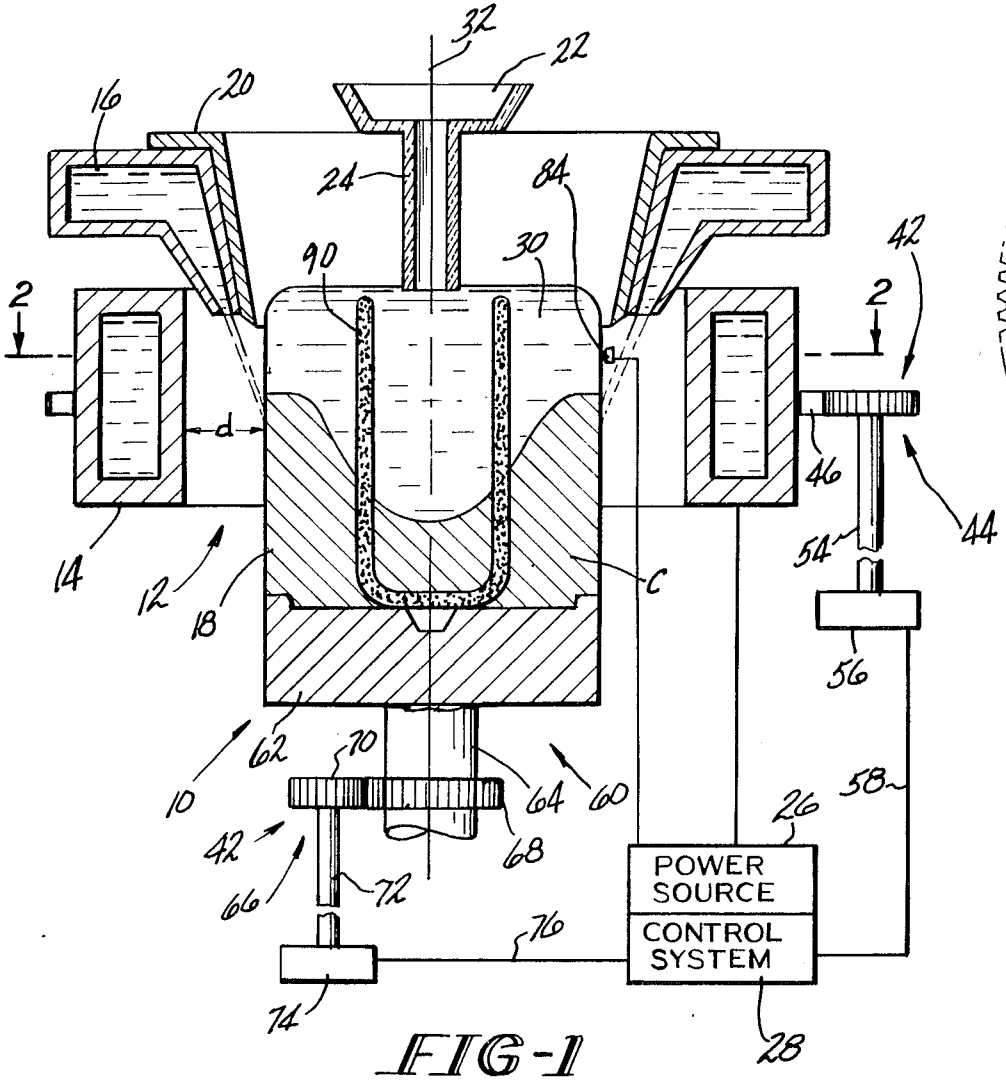
FIG. 1 is an illustration of an electromagnetic casting system in accordance with the present invention.

Referring to FIG. 1, there is shown an electromagnetic casting apparatus 10. The apparatus includes an electromagnetic casting mold 12 which is comprised of a water cooled inductor 14; a cooling manifold 16 for applying cooling water to the peripheral surface 18 of the molten material being cast C; and a non-magnetic screen 20. Molten material such as metal is introduced into the mold 12 during a casting run using a trough 22, downspout 24 and molten metal gap control in accordance with this invention. The inductor 14 is excited by an alternating current from a power source 26 which is controlled by a control system 28.

The alternating current in the inductor 14 produces a magnetic field which interacts with the molten metal head 30 to produce eddy currents therein. These eddy currents in turn interact with the magnetic field and produce forces which apply a magnetic pressure to the molten metal head to contain it in the zones defined by the magnetic field so that it solidifies into an ingot C having a desired cross section.

An air gap "d" exists between the molten head 30 and the inductor 14. The molten head is formed or molded into the same general shape as the corresponding inductor thereby providing the desired ingot cross section. The inductor may have any desired geometrical shape as required to obtain the desired cross section of ingot C.

The purpose of the non-magnetic shield 20 is to fine tune and balance the magnetic pressure with the hydrostatic pressure of the molten metal head. The non-magnetic screen may comprise a separate element as shown or may, if desired, be incorporated as a unitary part of the manifold 16 for applying the coolant.

Figure 3:
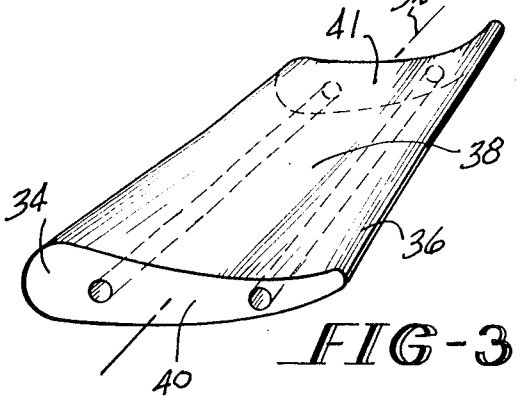
FIG. 3 is a plan view of a casting produced by the casting system.

The present invention is particularly concerned with the formation of castings having a non-uniform cross section with respect to a longitudinal axis 32 extending therethrough. An example of such a casting, as seen in FIG. 3, has a desired transverse cross section 34 extending perpendicular to the longitudinal axis. At least one portion 36 of the outer peripheral surface 38 of the casting extending transversely to the longitudinal axis has a small radius of curvature. The ingot of FIG. 3 represents a turbine blade which has a complex cross section. Also, although the cross section may remain uniform along the length, it may be rotated about the longitudinal axis of the blade to produce a twist in the section. Further, it may be desirable, with a casting such as a turbine blade, to form the head and tail 40 and 41, respectively, of different area although the shapes are similar in the geometric sense. All of these features may be accomplished through the principles, apparatus and process set out in this disclosure.

Figure 2:
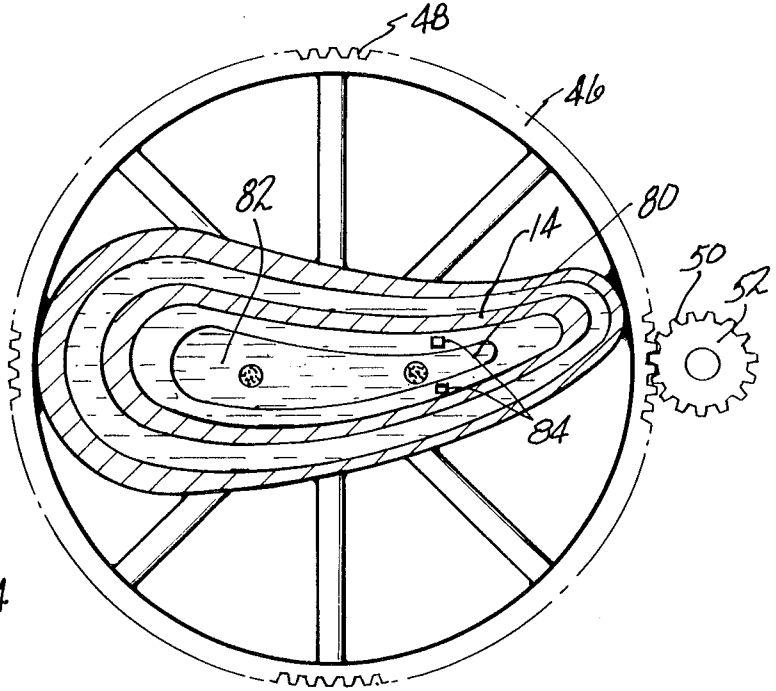
FIG. 2 is a view through section 2—2 of FIG. 1.

Referring to FIGS. 1 and 2, the apparatus 10 includes an inductor 14 extending transversely about the molten material for providing an electromagnetic containment force acting on the outer peripheral surface of the molten material to form the desired cross section. The inductor may have any desired shape to form the desired cross section and is not limited to the configuration shown in FIGS. 1 and 2.

A device 42 is provided for turning the electromagnetic containment force field about the longitudinal axis 32 to cause a corresponding turn of the transverse cross section of the molten material about the longitudinal axis. This turning device may include an apparatus 44 for rotating the inductor about the longitudinal axis. The device 44 may include a disc-like structure 46 affixed to the inductor 14 in any conventional manner. The outer circumference of the disc 46 may have teeth 48 extending any desired distance and preferably about the whole outer periphery. The teeth 48 engage the teeth 50 provided on a drive wheel 52. The drive wheel is attached through a shaft 54 to a drive motor 56. The motor 56 is operated by control system 28 which sends signals through a line 58 to the motor 56.

A device 60 for withdrawing the casting from the inductor 14 is also provided. This withdrawal device includes a bottom block 62, for supporting the bottom, downstream end of the casting C, which is attached to a ram assembly 64 positioned below the inductor for movement axially of the inductor along the axis 32. This ram may be withdrawn from the inductor in any conventional manner, such as by a hydraulic actuator. The device 60 may also include a device 42 for turning the electromagnetic force field which includes a rotating apparatus 66 similar to the apparatus 44. Apparatus 66 may comprise a collar 68 affixed by conventional means to the ram 64. The collar may be provided with teeth about its outer periphery to engage the teeth on a wheel 70. The wheel 70 is rotated by a rod 72 which may be connected to a motor 74. The control system 28 sends a signal through line 76 to activate the motor 74 as required. As the ram 64 is withdrawn from the inductor, it is also necessary for the turning device 66 to withdraw at the same rate whereby the elements 68 and 70 remain engaged with one another. Although the preferred embodiment for providing the turning function of the invention has been disclosed, it is within the scope of the present invention to use only one of the devices 44 or 66 or any other means of turning the magnetic field with respect to the molten metal as desired.

The present invention also includes a device for controlling the solidification rate across the transverse cross section whereby the at least one portion of the outer peripheral surface, i.e. at the small radius of curvature, solidifies at substantially the same rate as the portions of the outer peripheral surface adjacent to the at least one portion. The actual location of the solidification front results from a balance of the heat input from the superheated liquid material and the resistance heating from the induced currents in the ingot surface layer with the longitudinal heat extraction resulting from the cooling water application. By referring to FIG. 2, it can be appreciated that uniform rate and height of peripheral coolant flow directed at the surface of the forming ingot at the thinner portion of the cross section, i.e. at the section 80, results in the solidification front rising at the thinner section as compared to the solidification front closer to the thicker portion 82 of the casting. Stated another way, the height of the solidification point from the point of coolant impingement at the thin section is greater than the height of the solidification point from the point of coolant along the thicker section of the forming ingot. In addition, there may be a problem of the rounding off of the corners due to higher electromagnetic pressure at a given distance from the inductor near the corners, where two approximate faces of the single turn inductor generate field, as compared to the pressure at the same distance from the inductor on the broad faces or other shapes remote from the corner, where only one inductor face acts. Both of these problems are more fully described and solutions provided in U.S. Pat. No. 4,321,959 to Yarwood et al. which is incorporated by reference herein.

The present invention may include a means for controlling the solidification rate comprised of an apparatus to apply a local heat source to the thin section. For example, one or more high frequency induction coils 84 may be provided near the thin section. The high frequency induction coils would supply little containment pressure and would be used strictly for temperature gradient control. It is also within the scope of the present invention to use other devices for applying a local heat source, such as for example, a high powered laser for an electronic beam.

As set out in U.S. Pat. No. 4,321,959, the device for controlling the solidification rate may include selectively reducing the coolant delivered to the outer peripheral surface of the casting. For example, the coolant application rate may be reduced near the thin section and/or the elevation of the coolant contact against the solidified shell may be lowered at the thin section so as to reduce the local heat extraction rate along the transverse cross section line of constant height. This lowers the position of the solidification front at the narrow section of the ingot and correspondingly reduces the tendency for the thin section of the ingot to solidify before the thicker section.

The apparatus of the present invention includes a power source 26 for applying an alternating current to the inductor to generate the magnetic force field. This power source may be adjusted by a control system 28 in accordance with the teachings of U.S. Pat. No. 4,161,206 to Yarwood et al. Then, the control system is adapted to control the current delivered to the inductor in a way so as to maintain a substantially constant inductance and thereby a substantially uniform ingot cross section. It is also within the present invention for the control system to be changeable by providing a programmable device such as a computer. The program might be arranged to adjust the current applied to the inductor so as to change the area of the transverse cross section while maintaining geometric similarity. For example, the current may be increased as the casting passes through the inductor so that the front or head end 40 of the casting, as shown in FIG. 3, has a larger cross-sectional area than the tail end 41. It is also within the scope of the present invention to change the amount of current applied to the inductor in a non-uniform manner depending on the desired cross section.

The present invention also includes the method of forming a passageway within the casting. Referring to FIG. 1, a solid core 90, such as baked sand or a ceramic, may be positioned in the electromagnetic field, such as upon the bottom block 62, prior to pouring the molten material. Then, as the casting is formed, the core 90 is embedded therein. Once the casting is solidified, the core may be removed and an internal passage remains. It is within the scope of the present invention to form the core in any desired shape or place it in different locations within the casting. Further, if desired, the core may be inserted down into the molten metal during the actual casting process (not shown).

In order to more fully understand the present invention, a description of its operation follows. The process for electromagnetically forming the molten material into a longitudinal casting defining a longitudinal axis therethrough requires first to provide an inductor having a desired cross section which extends transversely about the molten material to generate an electromagnetic containment force field acting on the outer peripheral surface of the molten material to form the desired cross section. Then, an alternating current is applied to the inductor to generate the magnetic force field. The molten material is directed into the containment field and the ram assembly is withdrawn at a desired rate. As the ram moves downward, the inductor may be rotated at a programmed speed by the control system signaling the motor 56 to turn the wheel 44 and the assembly 46. This causes a rotation of the inductor about the longitudinal axis whereby the electromagnetic containment field also turns about the longitudinal axis to cause a corresponding turn of the transverse cross section of the molten material. In the alternative, the ram assembly may rotate the casting about the longitudinal axis as it is withdrawn from the inductor. In that instance, a program in the control system 28 would signal the motor 74 to turn the wheel 70 and cause rotation of the collar 68 and corresponding thereto, the ram 64. It is also within the scope of the present invention to rotate both the inductor and the casting simultaneously, i.e. to rotate 42 and 44 together, to further turn the transverse cross section of the molten material about the longitudinal axis. As mentioned above, the solidification rate across the transverse section is controlled so that the portion of the outer peripheral surface at the smaller radius of curvature solidifies at substantially the same rate as the portions of the outer peripheral surface adjacent the smaller radius of curvature. This may be accomplished by control of the coolant delivered against the solidifying surface as described above.

In addition, it is within the scope of the invention to program the control system to change the current applied to the inductor to vary the electromagnetic force field applied to said molten metal head during the casting so as to change the area of the transverse cross section of said casting while maintaining geometric similarity.

The method and apparatus of this invention is particularly adapted to the continuous or semicontinuous casting of metals and alloys. Further details of the apparatus and method of electromagnetic casting can be gained from a consideration of the various patents and publications cited in this application, which are intended to be incorporated by reference herein.

While the invention has been described with reference to molten material, it can be applied to a wide range of metals, alloys, semi-metals, and semiconductors including nickel and nickel alloys, steel and steel alloys, aluminum and aluminum alloys, copper and copper base alloys, silicon, germanium, etc. These materials are mentioned by way of example, and it is not intended to exclude other metals, alloys, metalloids, or semimetal type materials.

It is apparent that there has been provided in accordance with this invention an electromagnetic casting apparatus and method which fully satisfies the objects, means, and advantages set forth hereinbefore. While the invention has been described in combination with the specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

I claim:

1. An apparatus for electromagnetically casting molten metal material into a longitudinally extending casting, comprising:

inductor means generating an electromagnetic containment force field adapted to apply said electromagnetic containment force field to the peripheral surface of said molten metal material, said force field defining a casting zone having a longitudinal axis in the direction of casting extending therethrough and a desired transverse cross section extending perpendicular to said longitudinal axis being adapted to receive said molten metal material and to form said casting with a corresponding desired transverae cross section;

means for rotating said inductor means about said longitudinal axis to rotate the transverse cross section of said force field so as to rotate the desired transverse cross section of the molten metal material in the casting zone about said longitudinal axis; and means for supporting the downstream end of said casting and withdrawing said casting from said casting zone.

2. An apparatus as in claim 1 wherein said withdrawing means includes ram assembly means positioned below said inductor means for movement along said longitudinal axis of said casting zone.

3. An apparatus as in claim 1 further including means for directing heat locally into said casting zone.

4. The apparatus of claim 1 further including passageway forming means disposed within said containment force field for forming a passageway in said casting.

5. The apparatus of claim 4 wherein the passageway forming means comprises a solid core.

6. A process for electromagnetically casting molten metal material into a longitudinally extending casting, comprising steps of:

providing an inductor for generating an electromagnetic containment force field adapted to be applied to the peripheral surface of the molten metal material, said force field defining a casting zone having a longitudinal axis in the direction of casting extending therethrough and a desired transverse cross section extending perpendicular to said longitudinal axis;

receiving said molten metal material within said casting zone and forming said molten material into a desired transverse cross section, corresponding to the desired transverse cross section of said force field;

rotating said inductor about said longitudinal axis to rotate the transverse cross section of said force field about said longitudinal axis whereby the desired transverse cross section of the molten metal material in the casting zone is rotated about said longitudinal axis; and withdrawing the casting from said casting zone.

7. The process of claim 6 whereby said withdrawing step includes the steps of:

providing a ram assembly positioned below said inductor for supporting the casting; and moving said ram assembly axially of said inductor for withdrawing said casting from said inductor.

8. The process of claim 6 including the steps of:

providing a local heat source; and directing heat from said local heat source locally into the casting zone.

9. The process of claim 8, including the step of delivering a coolant into the casting zone to impinge on the peripheral surface of the casting.

10. The process of claim 9 further including the step of reducing the coolant delivered to at least one portion of the peripheral surface of said casting as compared to an adjacent portion of the peripheral surface.

11. The process of claim 7 further including the step of varying the electromagnetic force field applied to said molten metal material to change the area of the transverse cross section of said casting while maintaining geometric similarity.

12. The process of claim 7 further including the step of disposing a solid core within said containment force field to form a passageway within said casting.

* * * * *